United States Patent [19]

Nishikawa

[11] 4,413,044

[45] Nov. 1, 1983

[54] ELECTROPHOTOGRAPHIC COPYING PROCESS

[75] Inventor: Masaji Nishikawa, Hachioji, Japan

[73] Assignee: Olympus Optical Company Ltd., Tokyo, Japan

[21] Appl. No.: 322,412

[22] Filed: Nov. 18, 1981

[30] Foreign Application Priority Data

Dec. 23, 1980 [JP] Japan ..... 55-182321

[51] Int. Cl.[3] ..... G03G 13/22

[52] U.S. Cl. ..... 430/53; 430/55; 430/126; 101/DIG. 13

[58] Field of Search ..... 430/53, 55, 126; 101/DIG. 13

[56] References Cited

U.S. PATENT DOCUMENTS 3,414,409 12/1968 Gallo ..... 430/126 X
4,197,121 4/1980 Eckenbach ..... 430/126
4,229,511 10/1980 Katoh ..... 430/55
4,340,656 7/1982 Seino et al. ..... 430/55 X

*Primary Examiner*—Roland E. Martin, Jr.
*Attorney, Agent, or Firm*—Weinstein & Sutton

[57] ABSTRACT

An electrophotographic copying process employs a photosensitive member which includes a conductive layer carrying a sequential lamination of a photoconductive layer which is sensitive to visible light and a function layer different therefrom, forms an electrostatic latent image by trapping charge on opposite sides of either of the photoconductive layer and the function layer in such a condition that a layer which is not retaining the charge is one of photoconductive layers forming the photosensitive member, and repeatedly employs the electrostatic latent image to produce a plurality of copies. During the copying step for producing a plurality of copies, a uniform exposure by light rays which activate the one of photosensitive layers forming the photosensitive member which is not retaining the charge is applied to the photosensitive member.

7 Claims, 20 Drawing Figures

FIG. 5(A)
FIG. 5(B)
FIG. 5(C)
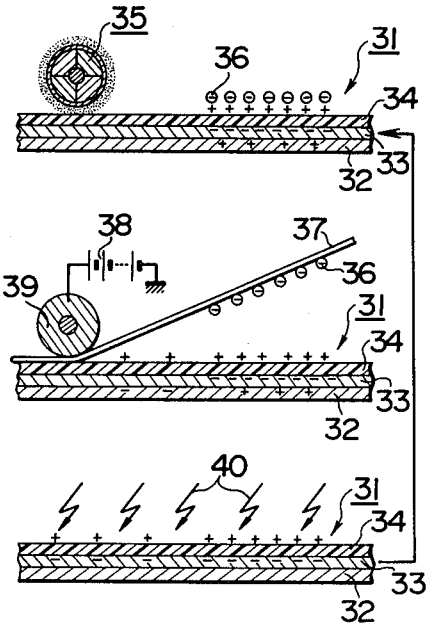
FIG. 6
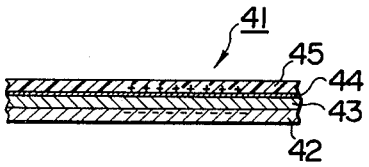
FIG. 7(A)
FIG. 7(B)
FIG. 7(C)
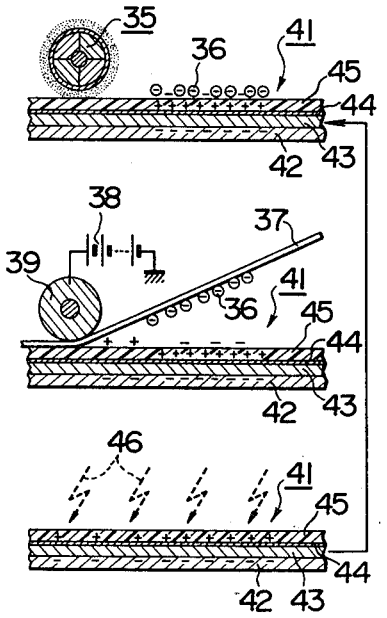

ELECTROPHOTOGRAPHIC COPYING PROCESS

BACKGROUND OF THE INVENTION

The invention relates to an electrophotographic copying process, and more particularly, to an electrophotographic copying process utilizing a photosensitive member which includes a conductive layer carrying a sequential lamination of a photoconductive layer which is sensitive to visible light (hereinafter referred to as a visible light photoconductive layer) and an insulator or a photoconductor which is different from the visible light photoconductive layer and serves a function independent thereof (hereinafter referred to as a function layer), forming an electrostatic latent image of an original to be copied by trapping charge on opposite sides of either of the visible light photoconductive layer and the function layer in such a condition that the layer which is not retaining the charge is one of photoconductive layers forming the photosensitive member, and repeatedly employing the electrostatic latent image to produce a desired number of copies.

A variety of electrophotographic copying apparatus have been hitherto proposed in the prior art which produces a plurality of copies by repeatedly employing an electrostatic latent image of originals which has been formed on the photosensitive member. By way of examples, there have been disclosed techniques such as (I) a procedure for forming the same copy images on a plurality of copy sheets by repeatedly subjecting an electrophotographic latent image which has been formed on a photosensitive member only to a developing step with toner and a transfer step and (II) a procedure for producing a plurality of copy images by initially forming a secondary latent image a plurality of times by repeating a step for forming the secondary latent image on a dielectric recording medium by modulating a corona ion current in accordance with an electrostatic latent image which has been formed on a screen-shaped photosensitive member, followed by a step for developing the secondary latent image, and subsequently followed by repeating a step for transferring the developed toner image onto a record sheet. In such an electrophotographic copying process that a plurality of copies are produced from the same latent image, it is necessary that in order to obtain a plurality of copy images of good quality, the electrostatic latent image which has been formed on the photosensitive member is maintained in a stable manner over a number of steps for copying. However, it is practical that there arises (1) a phenomenon in which charge on a member for retaining the latent image decays with the lapse of time, namely, a dark decay of the photosensitive member and a leakage of charge on an insulator, and (2) an injection of charge from the outside and a migration of charge to the outside. For example, the latent image may deteriorate by reason such as a charge migration through a developer and a charge injection caused during a transfer step in the electrophotographic copying process of example (I) described above, and a charge injection onto the screen-shaped photosensitive member caused by a detouring of a corona ion current which may arise during a formation of the secondary latent image in the electrophotographic copying process of example (II) described above. For the purpose of preventing such deterioration of the electrostatic latent image with the lapse of time, improvements in the electrophotographic copying process have been proposed. Specifically, one of such improvements is an electrophotographic copying process which employs a photosensitive member which includes a conductive layer carrying a sequential lamination of a visible light photoconductive layer and an insulator layer and forms an electrostatic latent image by trapping charges of opposite polarities on opposite sides of the insulator layer, respectively. Another one of such improvements is an electrophotographic copying process for producing a plurality of copies which employs a photosensitive member similar to that in the above described process, which member replaces the insulator layer with a photoconductive layer which is sensitive only to ultraviolet rays and forms an electrostatic latent image by trapping charge on opposite sides of the photoconductive layer which is sensitive to ultraviolet rays. Also, a further electrophotographic copying process for producing a plurality of copies has been proposed which prevents a migration of charge owing to a direct contact with a developer by trapping charge on opposite sides of a visible light photoconductive layer or an inner layer of a compound layer photosensitive member to form an electrostatic latent image. However, a conventional electrophotographic copying process for producing a plurality of copies which employs such a compound layer photosensitive member is favorably applicable in view of a fact that a decay of the latent image with the lapse of time or a charge migration through a developer during a developing step can be prevented. It should be understood, however, that such processes do not solve the problem of deterioration of the latent image by a charge injection which may be caused during a transfer step in the process (I) described above, or by a charge injection by a detouring of a corona ion current which may be caused during the step for forming a secondary latent image in the process (II) described above.

In the following, the electrophotographic copying processes for producing a plurality of copies in the above-mentioned examples (I) and (II) which employ such a compound layer photosensitive member will be described.

FIGS. 1(A) through (E) schematically illustrate a sequence of copying steps for the electrophotographic copying process (I) aforementioned. A photosensitive member 1 includes a conductive layer 2 on which is successively laminated a visible light photoconductive layer 3 and a light transmitting insulator layer 4. As indicated in FIG. 1(A), a uniform charging with a positive polarity, for example, is performed with a corona charger 5 in darkness. The result is such that when the dark resistance of visible light photoconductive layer 3 is low, charges of opposite polarities are trapped on opposite sides of insulator layer 4, as indicated in the figure. When the dark resistance of photoconductive layer 3 is sufficiently high, the charges are trapped on opposite sides of insulator layer 4 by a uniform charging simultaneously with a uniform exposure by visible light. Subsequently, as indicated in FIG. 1(B), a neutralization is performed by a charging with the opposite polarity or with an alternating current with a corona charger 6 simultaneously with an irradiation of an optical image 12 by visible light so that a surface potential of photosensitive member 1 reaches substantially zero volts. Thereafter, a uniform exposure by visible light 13 is applied, as indicated in FIG. 1(C). As a consequence, in a dark area of the image, a positive charge is trapped on the exposed surface of insulator layer 4 and a negative charge is trapped between insulator layer 4 and visible light photoconductive layer 3, respectively, thus forming an electrostatic latent image. The latent image, in a step for developing indicated in FIG. 1(D), is visualized by a negatively charged toner 8 under an operation of a developing unit 7 comprising a magnet roller, for example. Subsequently, in a step for transferring indicated in FIG. 1(E), the toner image on photosensitive member 1 is transferred onto a copy sheet 11 under an operation of a bias transfer roller 10 connected to a transfer bias source 9, for example. Thereafter, a plurality of copies can be produced with the latent image which has been formed on photosensitive member 1 by repeating a sequence of only those steps for developing and for transferring indicated in FIGS. 1(D) and (E).

Since the electrophotographic copying process for producing a plurality of copies indicated in FIGS. 1(A) through (E) forms the latent image by trapping charges of opposite polarities on opposite sides of insulator layer 4, respectively, a decay of the latent image with the lapse of time can be prevented. However, charge which is trapped on the surface of insulator layer 4 during the step for developing indicated in FIG. 1(D) migrates slightly through a developer, or a small quantity of charge is injected onto a non-image area (a bright area of the image) of photosensitive member 1 in accordance with the transfer electric field during the step for transferring indicated in FIG. 1(E) and a quantity of charge which issues from photosensitive member 1 and is injected thereonto is increased by a repetition of the steps for developing and for transferring, resulting in a decay of the latent image. With such decay of the latent image, as indicated in FIG. 2 with regard to the reflection factor of an original or the relation between exposures and surface potentials, a difference between potentials on the bright and the dark area of the image is sufficiently high, as shown with a solid line $a_0$, while after the repetition of the steps for developing and for transferring a potential on the dark area falls and a potential on the bright area rises, resulting in a decrease of the potential difference thereon, as shown with a broken line $b_0$. Consequently, the maximum density of resulted copies decreases as the number of copies produced increases and photographic fogging is increased, thus producing a low contrast copy image.

FIGS. 3(A) through (D) schematically illustrate a sequence of copying steps for an electrophotographic copying process in accordance with the process (II) in the foregoing. As shown, a screen-shaped photosensitive member 21 is formed in such a manner that a conductive mesh 22 is covered with a visible light photoconductor 23 therearound so as to be partially exposed and further an insulator 24 is laminated on the visible light photoconductor 23. As indicated in FIG. 3(A), a corona charging with positive polarity, for example, is uniformly applied from the insulator 24 side simultaneously with a uniform exposure 15 by light rays on the screen-shaped photosensitive member 21 so that charges of opposite polarities may be trapped on opposite sides of insulator 24 in the same manner as shown in FIG. 1(A). Subsequently, as indicated in FIG. 3(B), a corona charging 16 with the polarity opposite to that in FIG. 3(A) is performed simultaneously with an irradiation of an optical image of an original 25 from the insulator 24 side so that charge with a polarity opposite to that in a dark area of the image D may be trapped on opposite sides of insulator 24 in a bright area of the image L. Thereafter, as indicated in FIG. 3(C), a uniform exposure 17 is applied to the photosensitive member 21 to form an electrostatic latent image wherein a positive charge is trapped on the surface of insulator 24 in the bright area and a negative charge is trapped on the surface of insulator 24 in the dark area, respectively. After the latent image has been formed on the photosensitive member 21 as described above, a secondary latent image is formed on an insulator layer 27, as indicated in FIG. 3(D), which is a surface layer of a dielectric recording medium 28 which includes insulator layer 27 and a conductor 26. Specifically, a corona discharge wire 29 is disposed on the conductive mesh 22 side of photosensitive member 21 and dielectric recording medium 28 is disposed on the insulator 24 side. Further, a corona discharge power source 30*a* and an acceleration power source 30*b* are connected between corona discharge wire 29 and conductive mesh 22 and between conductive mesh 22 and conductor 26 of dielectric recording medium 28, respectively. To such arrangement thus formed is applied a voltage so as to develop a potential difference in the direction from corona discharge wire 29 through photosensitive member 21 to dielectric recording medium 28 and a corona ion current with negative polarity is projected toward dielectric recording medium 28 from corona discharge wire 29, as shown with broken lines. At this time, in the bright area of photosensitive member 21, since an electric field $\alpha$ is developed at an opening thereof in the direction that passing of the corona ion current with negative polarity is obstructed, the corona ion current flows into conductive mesh 22 which is exposed. In contrast, in the dark area of the image, since an electric field $\beta$ is developed at an opening thereof in the direction that passing of the corona ion current with negative polarity is promoted, the corona ion current reaches dielectric recording medium 28 through the opening. As a result, a secondary latent image is formed on dielectric recording medium 28, which corresponds to an electrostatic latent image formed on photosensitive member 21. After the secondary latent image formed on dielectric recording medium 28 is developed with toner, a copied image can be produced by transferring the toner image onto a copy sheet. Additionally, it is to be understood that after the toner image has been transferred, the secondary latent image is formed by repeating steps for cleaning and neutralizing dielectric recording medium 28, as shown in FIG. 3(D), whereby a plurality of copies can be produced with the electrostatic latent image which has been formed on screen-shaped photosensitive member 21.

In the electrophotographic copying process shown in FIG. 3, charge is trapped on opposite sides of insulator 24, in the same manner as in FIG. 1, to form the electrostatic latent image. Consequently, the latent image has little decay but is deteriorated by an injection of external charge caused by a detouring of the corona ion current into insulator 24 of photosensitive member 21 during a step for producing a plurality of copies or a step for forming the secondary latent image, a secondary emission on the surface of dielectric recording medium 28 and the like.

SUMMARY OF THE INVENTION

It is an object of the invention to eliminate the above described disadvantage occurring during the use of conventional techniques by providing an electrophotographic copying process wherein an electrostatic latent image which has been formed on a photosensitive member can be maintained in a stable manner without a deterioration thereof during a copying step for producing a plurality of copies.

In accordance with the invention, since a deterioration of the latent image by charge which is injected from the outside or charge which flows out during the copying step for producing a plurality of copies is caused to be removed, the number of copies to be produced from the same latent image can be greatly increased or the image quality of the copies can be highly improved while maintaining the allowable image quality.

While the photosensitive member of the invention includes a conductive layer carrying a sequential lamination of a visible light photoconductive layer and a function layer, the function layer may be formed with an insulator or a photoconductive layer which is sensitive to ultraviolet rays. When the photoconductive layer which is sensitive to ultraviolet rays is utilized, a filter layer which absorbs ultraviolet rays may be interposed between the ultraviolet photoconductive layer and the visible light photoconductive layer. Specifically, the function layer may be formed with an insulator or a photoconductor which has a function independent of the visible light photoconductive layer. When the photoconductor is employed, it may be made so as to be sensitive to visible light and/or ultraviolet rays in a wavelength region different from that of the visible light photoconductive layer. It is to be understood that the invention is used to produce a plurality of copies by employing such a compound layer photosensitive member and by utilizing an electrostatic latent image which is formed by trapping charge on opposite sides of either of the visible light photoconductive layer and the function layer in such a condition that a layer which is not retaining the charge is one of photoconductive layers forming the photosensitive member.

BRIEF DESCRIPTION OF THE DRAWINGS

FIGS. 5(A) through (C) schematically illustrate a sequence of copying steps for the electrophotographic copying process of the present invention which employs the photosensitive member indicated in FIG. 4;

FIG. 6 is a schematic cross section of another form of photosensitive member which is used in the present invention;

FIGS. 7(A) through (C) schematically illustrate a sequence of copying steps for the electrophotographic copying process of the present invention which employs the photosensitive member indicated in FIG. 6;

DESCRIPTION OF PREFERRED EMBODIMENTS

Figure 1A:
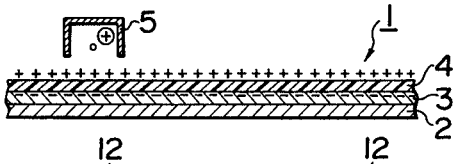
FIG. 1(A) (PRIOR ART)
FIGS. 1(A) through (E) schematically illustrate a sequence of copying steps for a conventional electrophotographic copying process which produces a plurality of copies.
Figure 1B:
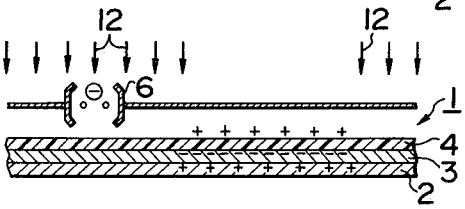
FIG. 1(B) (PRIOR ART)
Figure 1C:
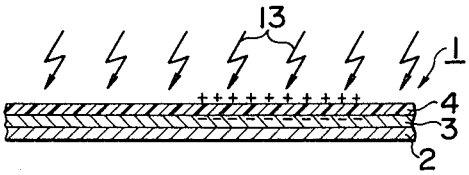
FIG. 1(C) (PRIOR ART)
Figure 1D:
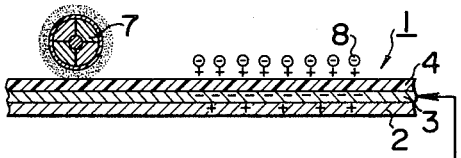
FIG. 1(D) (PRIOR ART)
Figure 1E:
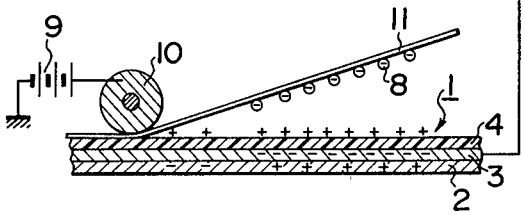
FIG. 1(E) (PRIOR ART)
Figure 2:
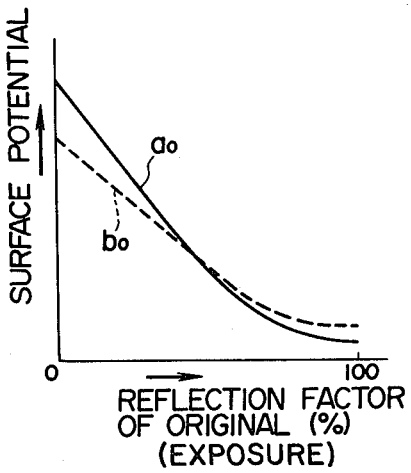
FIG. 2 graphically shows the relation between reflection factors of an original and surface potentials of the photosensitive member.
Figure 3A:
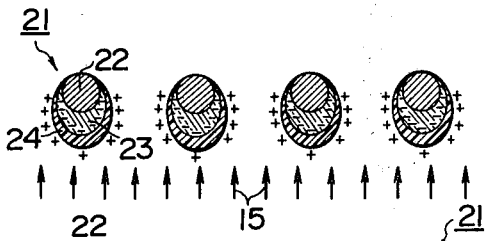
FIG. 3(A) (PRIOR ART)
FIGS. 3(A) through (D) schematically illustrate a sequence of copying steps for a conventional electrophotographic copying process which produces a plurality of copies employing a screen-shaped photosensitive member.
Figure 3B:
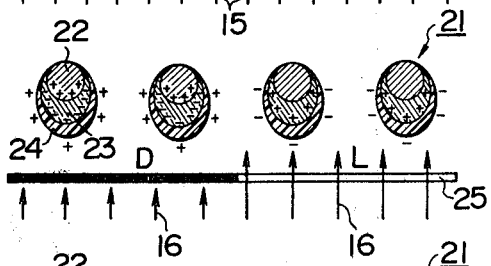
FIG. 3(B) (PRIOR ART)
Figure 3C:
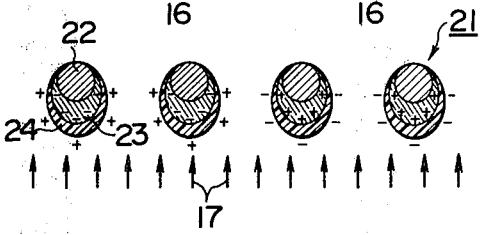
FIG. 3(C) (PRIOR ART)
Figure 3D:
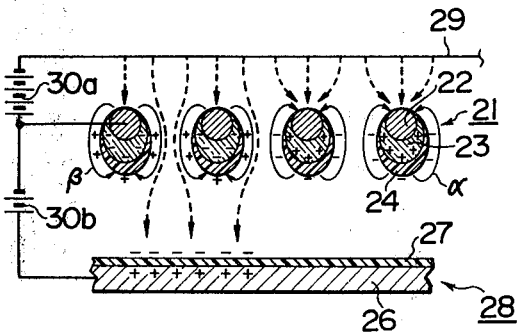
FIG. 3(D) (PRIOR ART)
Figure 4:
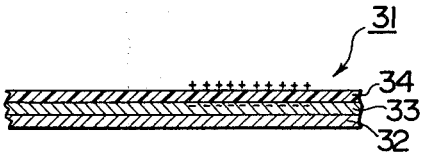
FIG. 4 is a schematic cross section of one form of photosensitive member which is used in the present invention.

Referring to FIG. 4, there is shown one form of photosensitive member which is used in the electrophotographic copying process of the present invention, in schematic cross section. A photosensitive member 31 shown comprises a conductive layer 32 carrying a successive lamination of a visible light photoconductive layer 33 and a function layer 34. The conductive layer 32 may be formed with a metal, or a plastic sheet or a paper sheet having a metallized surface. The visible light photoconductive layer 33 may comprise an inorganic photoconductor such as Se alloys, ZnO and CdS solidified with a binder or an organic photoconductor such as PVK (polyvinylcarbazole) containing a sensitizer. The function layer 34 serves as an insulator to visible light, as described in the foregoing and may be formed with a light transmitting plastic material which is non-photosensitive, or a photoconductor which is sensitive to ultraviolet rays and contains no sensitizer, or the like. With such photosensitive member 31, an electrostatic latent image is formed thereon by the process steps as shown in FIGS. 1(A) through (C), for example. FIG. 4 illustrates an electrostatic latent image formed by trapping charge on opposite sides of function layer 34 which serves as an insulator.

Subsequently, the sequential steps of the electrophotographic copying process of the present invention for producing a plurality of copies by repeatedly employing an electrostatic latent image formed as shown in FIG. 4 will be described with reference to FIGS. 5(A) through (C). In FIG. 5(A), illustrating a step for developing, a dry type developer, for example, is used to act on photosensitive member 31 by means of a magnet roll developing unit 35 and thereby the latent image is developed with toner 36. The developing operation is achieved based on action of an external electric field and part of the latent image charge leaks through the developer during the step for developing, whereby the charge on the surface of function layer 34 is reduced. However, charge which is on the reverse side of function layer 34 or at the interface between visible light photoconductive layer 33 and function layer 34 does not migrate as it is left trapped and charge equivalent to the lost charge on the surface of function layer 34 is induced within conductor 32. Consequently, an electric field effect that the lost charge affects the outside is determined by a resultant capacity between visible light photoconductive layer 33 and function layer 34, representing a larger effect than when charges on opposite sides of function layer 34 are only equal in quantity lost. This is because the resultant capacity between visible light photoconductive layer 33 and function layer 34 is smaller than the capacity of function layer 34 itself.

FIG. 5(B) illustrates a step for transferring the toner image on a copy sheet 37. In order to transfer the toner image without a deterioration of the latent image, it is preferable to use a bias transfer roller 39 connected to a transfer bias source 38. In such a transfer step, there are some cases where a charge injection arises at a portion where no latent image exists, namely, a non-image area or at a portion where a potential is low. This phenomenon is remarkably increased when a transfer bias voltage is high or copy sheet 37 is wet. The injected charge is trapped on the surface of function layer 34 and charge corresponding thereto is induced on conductor 32.

In a conventional electrophotographic copying process for producing a plurality of copies, which performs a repetition of only a developing step shown in FIG. 5(A) and a transfer step shown in FIG. 5(B), although a charge leakage and a charge injection at one time do not seriously instantly deteriorate the latent image, yet their accumulated effect largely deteriorates the image quality of a plurality of copies.

FIG. 5(C) illustrates a step for recovering the above described deterioration of the latent image according to the present invention which achieves a uniform exposure 40 by visible light. As a result of the uniform exposure 40, among the charge trapped on the back of function layer 34 at the portion corresponding to the dark area of the image, a quantity of charge corresponding to the surface charge which has disappeared during the developing step is released and disappears. Consequently, the effect on the exterior electric field by the charge disappeared during the developing step assumes an aspect that the charge has disappeared from the opposite sides of function layer 34, resulting in a sharp decrease thereof compared with the one before the uniform exposure by visible light. At a portion corresponding to the bright area of the image, charge corresponding to the charge injected during the transfer step is also on the back of function layer 34 by the uniform exposure by visible light and hence an electric field effect on the exterior electric field is reduced by half compared with the one before the uniform exposure by visible light. Thereafter, a repetition of a successive steps indicated in FIGS. 5(A) through (C) can produce a plurality of copies.

FIG. 6 is a schematic cross section of another form of photosensitive member which is used in the electrophotographic copying process of the present invention. As shown, a photosensitive member 41 is formed in such a manner that a visible light photoconductive layer 43 is laminated on a conductive layer 42, and a filter layer 44 for absorbing ultraviolet rays and a photoconductive layer 45 which is sensitive to ultraviolet rays are successively overlaid as a function layer on visible light photoconductive layer 43. Such photosensitive member 41 is subject to an imagewise irradiation after a corona charging in the same manner as the Carlson process, for example, and a further uniform exposure by ultraviolet rays, thereby forming an electrostatic latent image by trapping charge on opposite sides of visible light photoconductive layer 43. Since the latent image has its surface covered with ultraviolet photoconductive layer 45 which serves as an insulator layer, an effect of the exterior electric field is not obstructed and the latent image is not in direct contact with a developer during a developing step, resulting in that the charge leakage can be advantageously prohibited.

The sequential steps of the electrophotographic copying process of the present invention for producing a plurality of copies by repeatedly employing an electrostatic latent image formed on opposite sides of visible light photoconductive layer 43 as shown in FIG. 6 will be described with reference to FIGS. 7(A) through (C). FIG. 7(A) illustrates a developing step, in which a dry type developer is applied to photosensitive member 41 by means of a magnet roll developing unit 35 in the same manner as in FIG. 5(A) and the latent image is developed with toner 36. At this time, since the latent image is formed by trapping charge on opposite sides of visible light photoconductive layer 43 and the latent image is not in direct contact with the developer, there is no direct leakage of the latent image charge, but some charges are injected onto the surface of ultraviolet photoconductive layer 45 through the developer and the opposite polarity charge corresponding thereto is induced on conductive layer 42.

In FIG. 7(B), which illustrates a toner image transfer step, the toner image is transferred to copy sheet 37 under action of a bias transfer roller 39 connected to a transfer bias source 38 in the same manner as in FIG. 5(B). It is to be understood that charge is injected onto a non-image portion during this step in the same manner as in FIG. 5(B).

FIG. 7(C) illustrates a step for a uniform exposure of ultraviolet rays which characterizes the present invention. Ultraviolet photoconductive layer 45 is activated by a uniform exposure 46 of ultraviolet rays and the charge which has been trapped on the surface of ultraviolet photoconductive layer 45 migrates therewithin to be retrapped on the surface of visible light photoconductive layer 43 or on the light irradiation side thereof. Before the uniform exposure of ultraviolet rays, since the injected charge is retained in the resultant capacity of visible light photoconductive layer 43, ultraviolet absorbing filter layer 44 and ultraviolet photoconductive layer 45, the external electric field effect is strong, while after the uniform exposure of ultraviolet rays, since the injected charge is retained on visible light photoconductive layer 43, the external electric field effect is weak.

Therefore, a repetition of sequential steps shown in FIGS. 7(A) through (C) can produce a plurality of copies.

Figure 8:
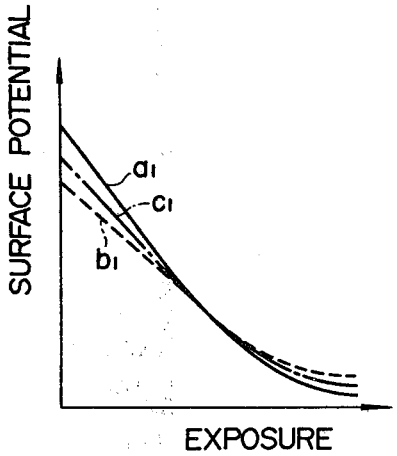
FIG. 8 graphically shows the relation between reflection factors of an original and surface potentials of the photosensitive member with regard to the process of the present invention and a conventional copying process.

FIG. 8 graphically shows the variation in potentials of the latent image with regard to the process of the present invention and a conventional prior art process, in which the abscissa represents an exposure and the ordinate represents a surface potential of the photosensitive member. The solid line $a_1$ represents a condition immediately after the latent image is formed. The broken line $b_1$ represents a condition that the latent image is deteriorated during a conventional electrophotographic copying process for producing a plurality of copies. In the dark area of the image, the latent image potential decreases while in the bright area of the image, the potential rises, as shown. As the number of copies increases, the maximum density of the copy image decreases and a fogging thereof increases, resulting in a low contrast of the copy image. In addition, the dot-dash line $C_1$ represents a condition at the time when light rays are applied which do not activate a layer which is retaining the latent image charge but activate a photoconductive layer which is not retaining the same during the copying step for producing a plurality of copies according to the present invention. The degree of a preventive function against deterioration of the latent image according to the present invention is determined by the specific electrostatic capacity Ca of the layer which is retaining the latent image charge and the specific electrostatic capacity Cb of the photoconductive layer which is not retaining the latent image charge and the preventive effect corresponds to the ratio of $Cb/Ca+Cb$. Therefore, when Ca equalizes with Cb, a deterioration of the latent image can be reduced to $\frac{1}{2}$.

Figure 9:
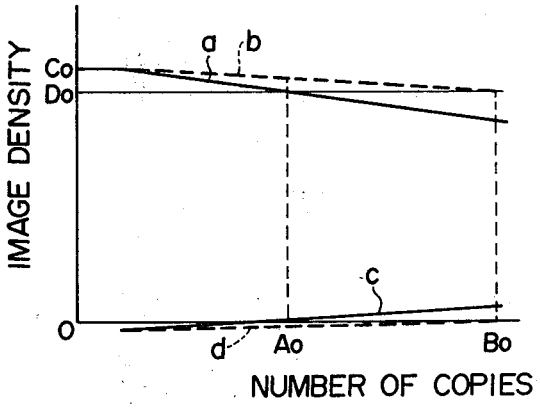
FIG. 9 graphically shows the relation between the number of copies and image densities with regard to the process of the present invention and a conventional copying process.

FIG. 9 graphically shows the relation between the number of copies and density of the copy image with regard to an electrophotographic copying process for producing a plurality of copies according to the prior art and the present invention, in which the abscissa represents the number of copies and the ordinate represents density of the latent image. The latent image in the early stage of the process has the maximum density of $C_0$ and no fogging in a non-image portion. Assuming that the practical level of the maximum density is $D_0$, according to the density variation of the latent image in the prior art as shown with a solid line a, the number of copies that reaches the density $D_0$ is $A_0$. In contrast, according to the density variation of the latent image in the process of the present invention as shown with a broken line b, a good density can be maintained until the number of copies reaches $B_0$ in the figure which is much larger than $A_0$. Similarly, there makes a difference also in fogging density. A potential at a non-image portion is practically lower than the potential that a developing operation is applicable. On the assumption that in the prior art process shown with a solid line c, a line portion below the density 0 represents the allowance for occurrence of fogging and the number of producible copies is $A_0$ under the condition that a slight fogging at a background is allowed in the prior art process, a much larger number of copies B are producible in the process of the present invention shown with a broken line d when a fogging in the same degree as in the prior art process is allowed. In other words, making a comparison with regard to the number of copies, the process of the present invention can obtain a copy image much better than in the prior art process.

It is to be noted that the electrostatic copying process for producing a plurality of copies of the present invention in which a uniform exposure by light rays activating a photoconductive layer which is retaining no latent image is carried out during the copying process for producing a plurality of copies, is effectively applicable to the case that employs the screen-shaped photosensitive member as described in FIG. 3. Specifically, in this case, wherein a plurality of copies are produced by a repetition of the process for forming a secondary latent image indicated in FIG. 3(D), a corona ion current is injected onto the insulator layer which forms a surface layer of the screen-shaped photosensitive member during the process for forming the secondary latent image and thereby the latent image is deteriorated as described in the foregoing. When a uniform exposure by visible light is carried out during the copying process for producing a plurality of copies in order to remove a deterioration of the latent image by the injected charge, the deterioration thereof can be removed by the same phenomenon that a leakage action of the latent image charge through a developer as shown in FIG. 5(A) decreases by an irradiation by visible light.

In the present invention, in order to obtain a sufficient effect, an irradiation of light rays for activating a layer which is retaining no latent image during the copying step for producing a plurality of copies may be performed every time a copy is produced or at one time to every n copies ($n \geqq 1$). Further, while the process of the present invention employs the photosensitive member which includes a conductive layer carrying a sequential lamination of a visible light photoconductive layer and a function layer different therefrom, forms an electrostatic latent image by trapping charge on opposite sides of either of the visible light photoconductive layer and the function layer in such a condition that a layer which is not retaining the charge is one of photoconductors forming the photosensitive member, and repeatedly employs the electrostatic latent image to produce a plurality of copies, it is to be noted that the process for forming such latent image is not limited only to the above described embodiments.

What is claimed is:

1. An electrophotographic copying process utilizing a photosensitive member which includes a conductive layer carrying a sequential lamination of a photoconductive layer which is sensitive to visible light and a function layer different therefrom, forming an electrostatic latent image by trapping charge on opposite sides of either the photoconductive layer or the function layer in such a condition that the layer which is not retaining the charge is a photoconductive layer forming the photosensitive member, the function layer being formed of a layer taken from the group of layers consisting of a photoconductive layer and an electrically insulating layer, and repeatedly employing a copying step for developing the electrostatic latent image and transferring the toner deposited on said latent image to produce a plurality of copies, characterized in that the photosensitive member is subjected to at least one uniform exposure by radiation which activates that photoconductive layer forming the photosensitive member which is not retaining the charge during at least one of the copying steps for producing a plurality of copies of substantially uniform quality.

2. An electrophotographic copying process according to claim 1 in which the function layer comprises an electrically insulating layer on which the electrostatic latent image is to be formed and to which the uniform exposure comprises exposing the photosensitive member to visible light during said one of the copying steps for producing a plurality of copies.

3. An electrophotographic copying process according to claim 1 in which the function layer comprises a photoconductive layer which is activated by ultraviolet rays, the electrostatic latent image being formed on opposite sides of the photoconductive layer which is sensitive to visible light, and the photosensitive member is uniformly exposed to ultraviolet rays during the said one copying step for producing a plurality of copies.

4. An electrophotographic copying process according to claim 1 in which the uniform exposure is carried out between the transfer step and the developing step performed during the copying process for producing a plurality of copies.

5. An electrophotographic copying process according to claim 1 in which the photosensitive member has a screen-shaped configuration.

6. An electrophotographic copying process according to claim 1 in which a uniform exposure by light rays for activating one of said photoconductor layers is performed during more than one of said copying steps up to a maximum of once during each copying step.

7. An electrophotographic copying process according to claim 1 wherein the electrostatic capacity Ca of the layer retaining the latent image charge is made at least equal to the capacity Cb of the layer not retaining the latent image charge to further reduce the deterioration of the latent image when making multiple copies of an original.

* * * * *

UNITED STATES PATENT AND TRADEMARK OFFICE

CERTIFICATE OF CORRECTION

PATENT NO. : 4,413,044

DATED : November 1, 1983

INVENTOR(S) : Nishikawa

It is certified that error appears in the above—identified patent and that said Letters Patent is hereby corrected as shown below:

Column 2:

Line 46, change "1" to --1--;

Line 64, change "1" to --1--.

Column 3:

Lines 8, 13, 26, and 29: change "1" to --1-- at each occurrence.

Lines 50 and 58, change "21" to --21-- at each occurrence.

Column 4:

Lines 2, 7, 13, 22, 27, 40, 50 and 57, change "1" to --1-- at each occurrence.

Lines 10, 14, 19, 23, 25, 36, 38, 41, 47 and 61, change "28" to --28-- at each occurrence.

UNITED STATES PATENT AND TRADEMARK OFFICE

CERTIFICATE OF CORRECTION

PATENT NO. : 4,413,044

DATED : November 1, 1983

INVENTOR(S) : Nishikawa

It is certified that error appears in the above—identified patent and that said Letters Patent is hereby corrected as shown below:

Column 6:

Lines 13, 28 and 41, change "31" to --31--;

Line 42, change "35" to --35--.

Column 7:

Lines 41, 47 and 67, change "41" to --41-- at each occurrence;

Line 68, change "35" to --35--.

* * *

Signed and Sealed this

Ninth Day of October 1984

[SEAL]

Attest:

GERALD J. MOSSINGHOFF

Attesting Officer

Commissioner of Patents and Trademarks